US008101233B2

(12) United States Patent
Rodrigues et al.

(10) Patent No.: US 8,101,233 B2
(45) Date of Patent: Jan. 24, 2012

(54) POWDER PUMP WITH VACUUM FILLING

(75) Inventors: Jose Rodrigues, Hafrsfjord (NO); Cedric Foulet, Grenoble (FR)

(73) Assignee: Eisenmann AG (DE)

( * ) Notice: Subject to any disclaimer, the term of this patent is extended or adjusted under 35 U.S.C. 154(b) by 289 days.

(21) Appl. No.: 12/376,216

(22) PCT Filed: Jul. 18, 2007

(86) PCT No.: PCT/EP2007/006342
§ 371 (c)(1),
(2), (4) Date: May 13, 2009

(87) PCT Pub. No.: WO2008/014886
PCT Pub. Date: Feb. 7, 2008

(65) Prior Publication Data

US 2009/0263575 A1 Oct. 22, 2009

(30) Foreign Application Priority Data

Aug. 4, 2006 (FR) ..... 06 07165

(51) Int. Cl.
*B05D 1/02* (2006.01)
*B05B 7/14* (2006.01)

(52) U.S. Cl. ..... 427/185; 427/459; 427/421.1; 118/309; 118/629

(58) Field of Classification Search ..... 427/185, 427/459, 421.1; 118/309, 629
See application file for complete search history.

(56) References Cited

U.S. PATENT DOCUMENTS 4,288,466 A * 9/1981 Heckman et al. ..... 427/461
2005/0178325 A1 * 8/2005 Herre et al. ..... 118/308
* cited by examiner

*Primary Examiner* — Frederick Parker
(74) *Attorney, Agent, or Firm* — Factor Intellectual Property Law Group, Ltd.

(57) ABSTRACT

A powder supply system for a powder-coating installation, especially a parts painting installation using electrostatic powder, according to the invention, comprises a tank designed to contain the powder, means for feeding powder into the tank, means for injecting compressed air into the bottom of the tank in order to fluidize the powder, and an exit pipe in which the powder is entrained by the air from the tank, this pipe being connected to at least one powder using device situated at a distance, in particular a spray gun. The system also includes means for reducing the pressure in the tank below that of the feed means in order to fill the tank with powder.

16 Claims, 3 Drawing Sheets

POWDER PUMP WITH VACUUM FILLING

RELATED APPLICATIONS

This application claims the filing benefit of International Patent Application No. PCT/EP2007/006342, filed Jul. 18, 2007, which claims the filing benefit of French Patent Application No. 06/07165 filed Aug. 4, 2006, the contents of all of which are incorporated herein by reference.

TECHNICAL FIELD

The present invention relates to an item of equipment for supplying powder to a powder-coating installation, in particular an installation for painting components using electrostatic powder, and a method for supplying powder to a powder-coating installation.

BACKGROUND OF THE INVENTION

A powder-coating installation which is provided with powder spraying devices generally has a conveyor which allows the components which are to be painted to be moved in front of spraying devices. Each component, in accordance with the size and the shape thereof, requires the flow rate of powder projected by the spraying devices to be adjusted in an appropriate manner. The spraying devices therefore need to be supplied, from a remote location, with a powder flow rate which is controlled and which can be adjusted, the powder being fluidised and conveyed by means of compressed air. The flow of powder is therefore advantageously metered, the powder is mixed with compressed air and the air/powder mixture is moved by conveying it to the powder-coating installation, in order to supply the spraying device(s) or "guns" of this installation.

An item of equipment for supplying powder to such an installation is generally produced based on the principle of a Venturi pump which has the effect of moving the powder by means of air.

Since the Venturi pump draws powder into a container which is placed under atmospheric pressure, there is consequently a limitation of the flow rate of powder in accordance with the length of the pipe between the pump and the powder-coating installation, the length of this pipe being from approximately ten to fifteen meters in accordance with the flow rate of powder desired. In any case, such a system does not allow sufficient quantities of powder to be conveyed over a large distance, in particular greater than 20 meters, and requires a high conveying speed, the minimum speed of the air in the pipe having to be in the order of from eight to ten meters per second.

Furthermore, the significant quantity of air used in this instance has a negative effect on the powder depositing yield, that is to say, on the ratio between the quantity of powder deposited and the quantity of powder sprayed. The air for conveying the powder has a tendency to blow away the powder already deposited on the component to be painted.

Furthermore, a system of this type has a tendency to cause the powder to melt owing to the friction thereof in the Venturi pump and the particles of molten powder then agglomerate and they bring about defects in the projected painting. The powder also creates an undesirable effect of abrasion in the mixing device.

As a result, other items of equipment have been proposed which allow the problems set out above to be overcome.

In particular, it is known to use an item of equipment which comprises:

- a reservoir, provided for containing the powder,
- means for conveying powder inside the reservoir,
- means for injecting compressed air into the lower portion of the reservoir, in order to fluidise the powder, and
- at least one pipe for discharging the powder carried by air, from the reservoir, this pipe being connected to at least one remote device for using the powder, in particular a spraying device.

Such an item of equipment which is known in particular from documents EP1454675 and FR2872067, allows the flow rate of powder applied to be controlled more readily and allows the quantity of air used to be reduced, which reduces the blowing effect in particular.

Furthermore, the speed of the mixture is lower in the equipment, which prevents the powder from melting.

In known items of equipment of this type, the means for conveying the powder into the reservoir from a filling container operate by means of gravity, or by using a pump in order to move the powder, these means being associated with a valve.

These measures bring about occurrences of powder compression in the region of the valve, and therefore polymerisation and agglomeration of the powder in the region of the valve, the agglomerations of powder then bringing about defects when the powder is applied to a component to be painted.

The present invention is directed to resolving these and other matters.

SUMMARY OF THE INVENTION

An object of the present invention is to overcome this technical problem, that is to say, to reduce the agglomerations of powder caused by the conveying means.

To this end, the present invention relates to an item of equipment of the above-mentioned type, characterised in that the item of equipment comprises means for reducing the pressure of the reservoir with respect to the conveying means for filling the reservoir with powder.

These measures allow the powder to be drawn into the reservoir from the means for conveying by means of reduced pressure, during a filling phase, then allow the reduced pressure to be neutralised during a spraying phase, and allow the conveying means to be closed by means of a valve only when the reduced pressure is neutralised.

As a result, the valve does not apply any force to the powder, which prevents the formation of agglomerates.

Preferably, the conveying means comprise a powder conveying conduit and a powder supply valve which is intended to block this conduit, the powder supply valve being associated with means for cleaning the valve when it is open.

These measures prevent the residual powder from becoming blocked in the region of the valve and forming a residual agglomerate by means of compression when the valve is closed.

Advantageously, the conveying conduit comprises at least one section which is substantially horizontal and in the region of which the powder supply valve is arranged.

These measures prevent the powder from becoming compressed by means of gravity.

Preferably, the means for reducing the pressure of the reservoir with respect to the conveying means comprise a Venturi device which is associated with means for separating the air and the powder.

Advantageously, the means for separating the powder and the air comprise a cyclone.

Preferably, the means for separating the powder and the air comprise a filter.

Advantageously, the means for reducing the pressure of the reservoir with respect to the conveying means comprise a valve which allows the flow of air to be stopped downstream of the pressure reduction means.

Preferably, the means for injecting compressed air comprise a blowing nozzle, which fluidises the powder and which is located opposite the end of the pipe during the spraying operation.

These measures allow local fluidisation of the powder in the region of the end of the pipe. The powder-coating flow rate in the discharge pipe is increased, this powder-coating flow rate having better homogeneity than the devices of the prior art. It is thus possible to increase the pressure in the reservoir in order to increase the flow rate whilst retaining a supply of fluidised powder in a homogeneous manner.

According to one embodiment, the equipment comprises means for moving the powder discharge pipe between a first position in which the powder in the reservoir is able to enter the pipe, and a second cleaning position in which the pipe is separated in a fluid-tight manner from the inner space of the reservoir.

Advantageously, in the second position, the pipe is positioned against an air blowing nozzle which allows the pipe to be cleaned.

These measures allow the pipe to be automatically cleaned and prevent an "expansion" effect at the beginning of a spraying phase, this effect being caused by the residual powder from the previous spraying phase remaining in the pipe.

Advantageously, the same air blowing nozzle allows the pipe to be cleaned when the pipe is in the lower position and allows the powder to be fluidised in the region of the end of the pipe when it is in the upper position.

These measures allow the structure of the equipment to be simplified by using the same nozzle for two different functions.

Preferably, the equipment comprises a permanent outlet which allows the pressure in the reservoir to be adjusted.

Advantageously, the air injection means comprise at least one proportional valve which allows the pressure in the reservoir to be adjusted.

The present invention also relates to a method for supplying powder to a powder-coating installation, in particular an installation for painting components using electrostatic powder comprising:

a phase for filling a powder reservoir from powder conveying means, and a spraying phase in which the powder is fluidised, and the reservoir is emptied via a discharge pipe to at least one remote device for using the powder, in particular a spraying device, the reservoir being placed in a state of reduced pressure with respect to the conveying means for at least part of the filling phase.

Advantageously, a flow for fluidisation of compressed air is maintained in the reservoir during the filling phase.

These measures allow any delay to be avoided in the powder-coating flow rate when the spraying phase begins.

Preferably, the conveying means comprise a powder supply valve which is intended to block a powder conveying conduit, the powder supply valve being cleaned, then closed at the end of the filling phase.

Advantageously, the reduced pressure of the reservoir with respect to the conveying means is neutralised before the powder supply valve is cleaned.

Preferably, the powder discharge pipe is moved between a first position during the spraying phase, in which the powder in the reservoir is able to enter the pipe, and a second position of during the filling phase, in which the pipe is separated in a fluid-tight manner from the inner space of the reservoir.

Advantageously, the pipe is cleaned by means of air being blown in the second position.

In any case, the invention will be correctly understood from the following description, with reference to the appended schematic drawing which illustrates, by way of non-limiting example, one embodiment of an item of equipment according to the invention.

It is to be further understood that the aspects and objects of the present invention described above may be combinable and that other advantages and aspects of the present invention will become apparent upon reading the following description of the drawings and detailed description of the invention.

DETAILED DESCRIPTION OF THE PRESENT INVENTION

Figure 1:
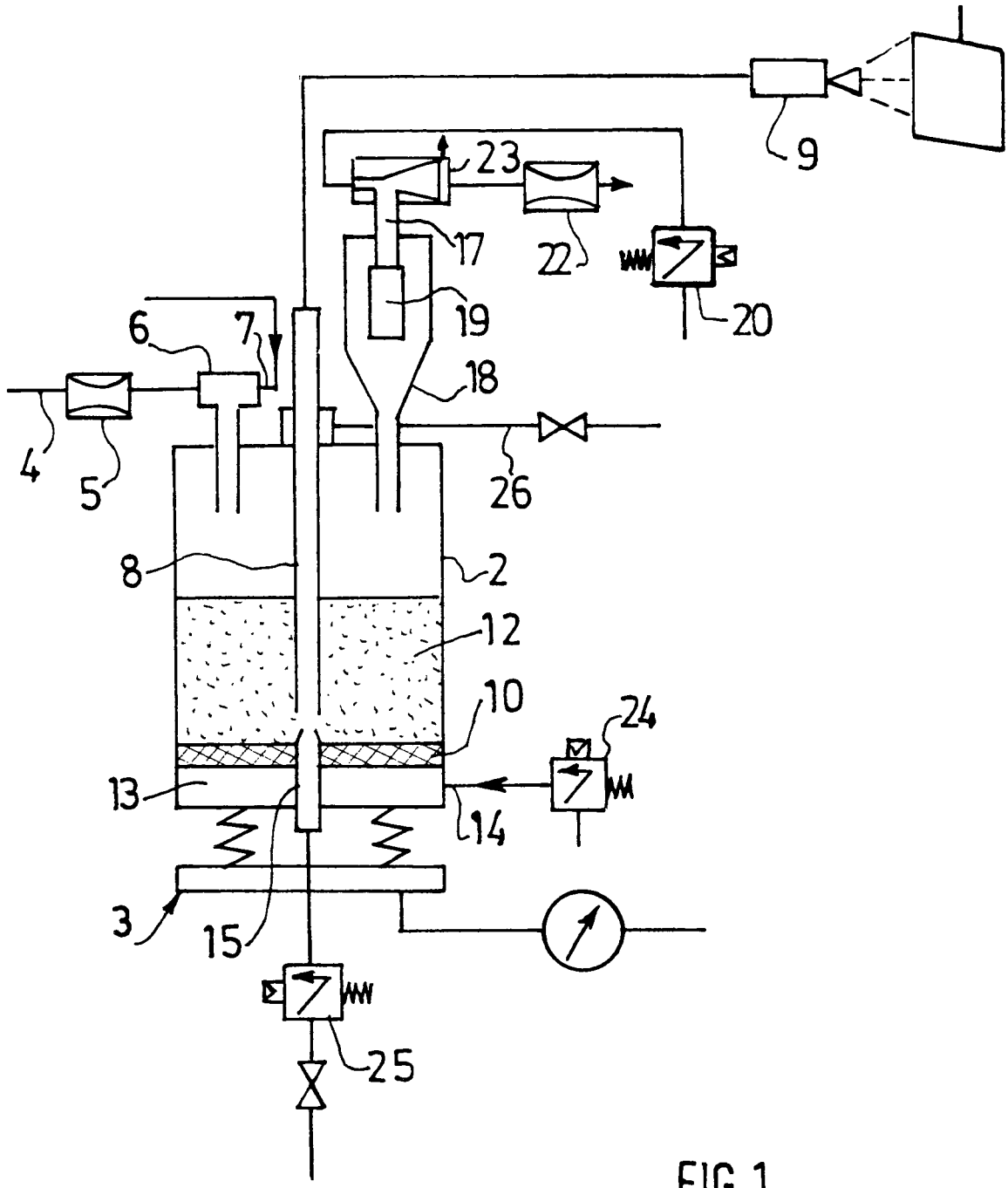
FIG. 1 is a general schematic view of an item of equipment according to the invention.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
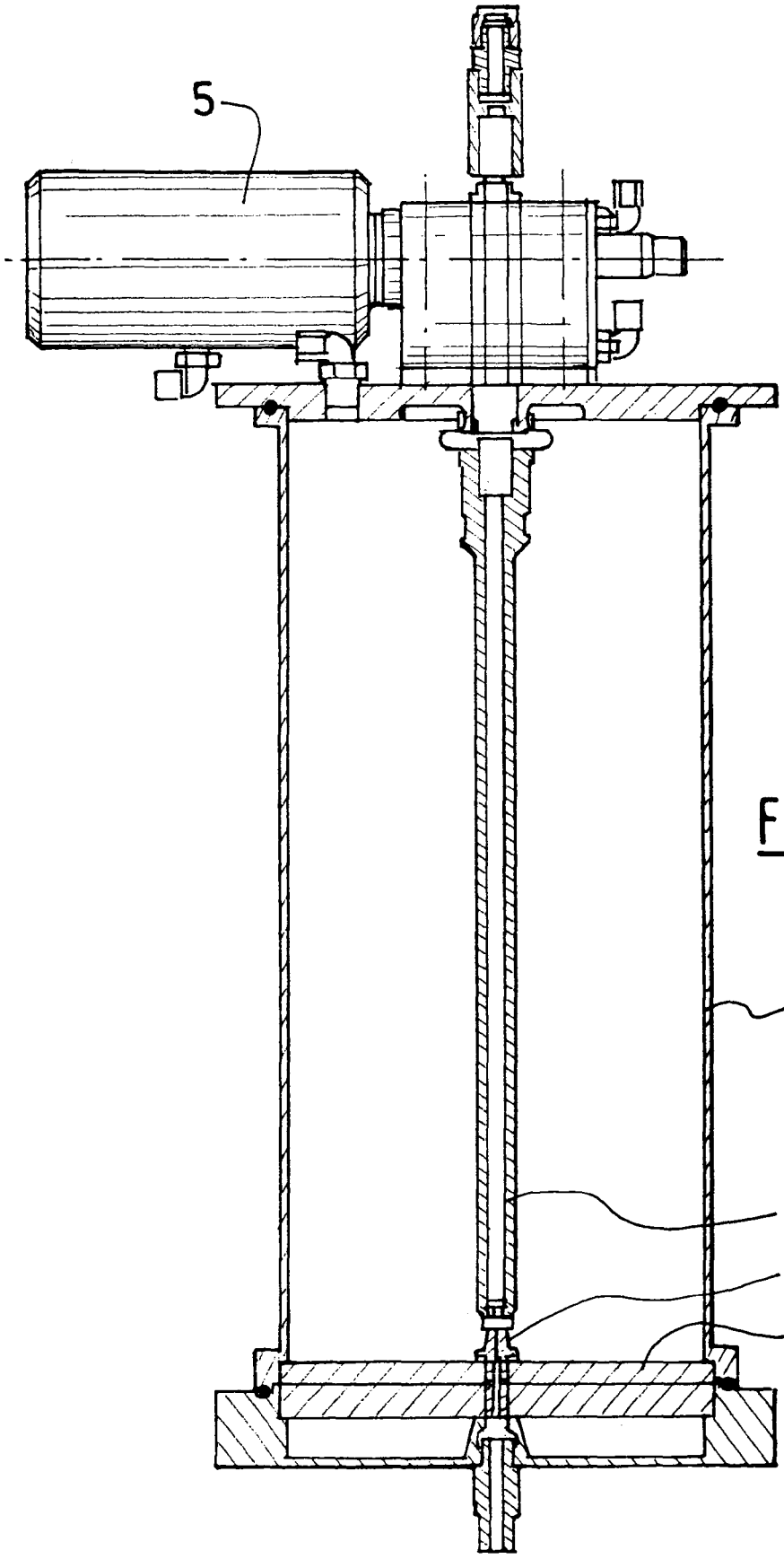
FIG. 2 is a sectioned view of a reservoir according to the invention, the discharge pipe being in the lower position.

As illustrated in FIGS. 1 and 2, an item of powder supply equipment for a powder-coating installation according to the invention comprises a reservoir 2, which is provided for containing powder. The equipment comprises means for measuring the quantity of powder in the reservoir 2, constituted, for example, by means 3 for weighing the mass of the reservoir 2.

The equipment also comprises means for conveying powder inside the reservoir. These conveying means comprise a conduit 4 for conveying to the reservoir 2 and a supply valve 5 which is intended to block the powder conveying conduit 4. The supply valve is of the pinch valve type.

The conveying conduit 4 is connected downstream to charging means which are not illustrated, in particular to a filling container.

The conveying conduit 4 is arranged substantially horizontally and the powder supply valve 5 is arranged in the region of a horizontal section of this conduit, which prevents powder from being compacted by gravity in the region of the valve 5.

At the downstream end thereof, the conveying conduit 4 is extended by an elbow 6 which opens in the upper wall of the reservoir. An air inlet 7 is provided in the region of the elbow 6, in the axis of and facing the conveying conduit. This compressed air inlet, which allows air to be propelled in an upstream direction in the conveying conduit 4, constitutes a means for cleaning the powder supply valve 5 in the open position.

The equipment also comprises a pipe 8 for discharging the powder which is carried by air, from the reservoir 2, this pipe being connected to a remote spraying device 9.

The equipment further comprises means for injecting compressed air in the lower portion of the reservoir, in order to fluidise the powder. The reservoir comprises a porous element 10 which delimits a first upper compartment 12 which contains the powder and a second lower compartment 13 of the reservoir 2 which contains compressed air, the air injection means comprise a first air inlet 14 which is located below the porous element 10 and a nozzle 15 whose opening is located below the end of the powder discharge pipe and above the porous element 10.

According to one feature of the invention, the equipment comprises means for reducing the pressure of the reservoir with respect to the conveying means. The means for reducing the pressure of the reservoir with respect to the conveying means comprise a Venturi device 16 whose intake member 17 is positioned at the centre of a cyclone 18 for separating the air and the powder. The cyclone 18 opens at the end of the conical portion thereof in the upper wall of the reservoir 2. A filter 19 is positioned on the intake member 17, which allows the separation of the air and the powder to be completed.

The Venturi device 16 is supplied by a proportional pressure reduction valve 20 which allows the intake rate and therefore the pressure reduction produced to be adjusted.

The pressure reduction means comprise a valve 22, of the pinch type, which allows the flow to be stopped in the pressure reduction means.

In the region of the output of the Venturi device 16, there is positioned a permanent outlet 23 which allows the pressure in the reservoir 2 to be reduced. The air injection means comprise proportional valves 24, 25 which also allow the pressure in the reservoir 2 to be adjusted. A pressure sensor which is not illustrated and which is placed in the reservoir allows a measurement of the pressure to be obtained and allows the pressure control to be implemented.

The equipment further comprises means 26 for moving the powder discharge pipe 8 between a first upper position in which the powder in the reservoir is able to enter the pipe, and a second lower cleaning position which is illustrated in FIG. 2 and in which the pipe 8 is positioned against the blowing nozzle 15 of the air injection means, which allows the pipe 8 to be cleaned.

Advantageously, the end of the discharge pipe 8 located in the reservoir is produced from a material which limits the polymerisation of the powder, in particular a polyamide material.

Using such an item of equipment, a method for supplying powder to a powder-coating installation can be implemented and comprises a phase for filling the reservoir with powder from powder conveying means and a spraying phase in which the powder is fluidised and the reservoir is emptied via the discharge pipe to at least one spraying device which is located remotely.

Figure 3:
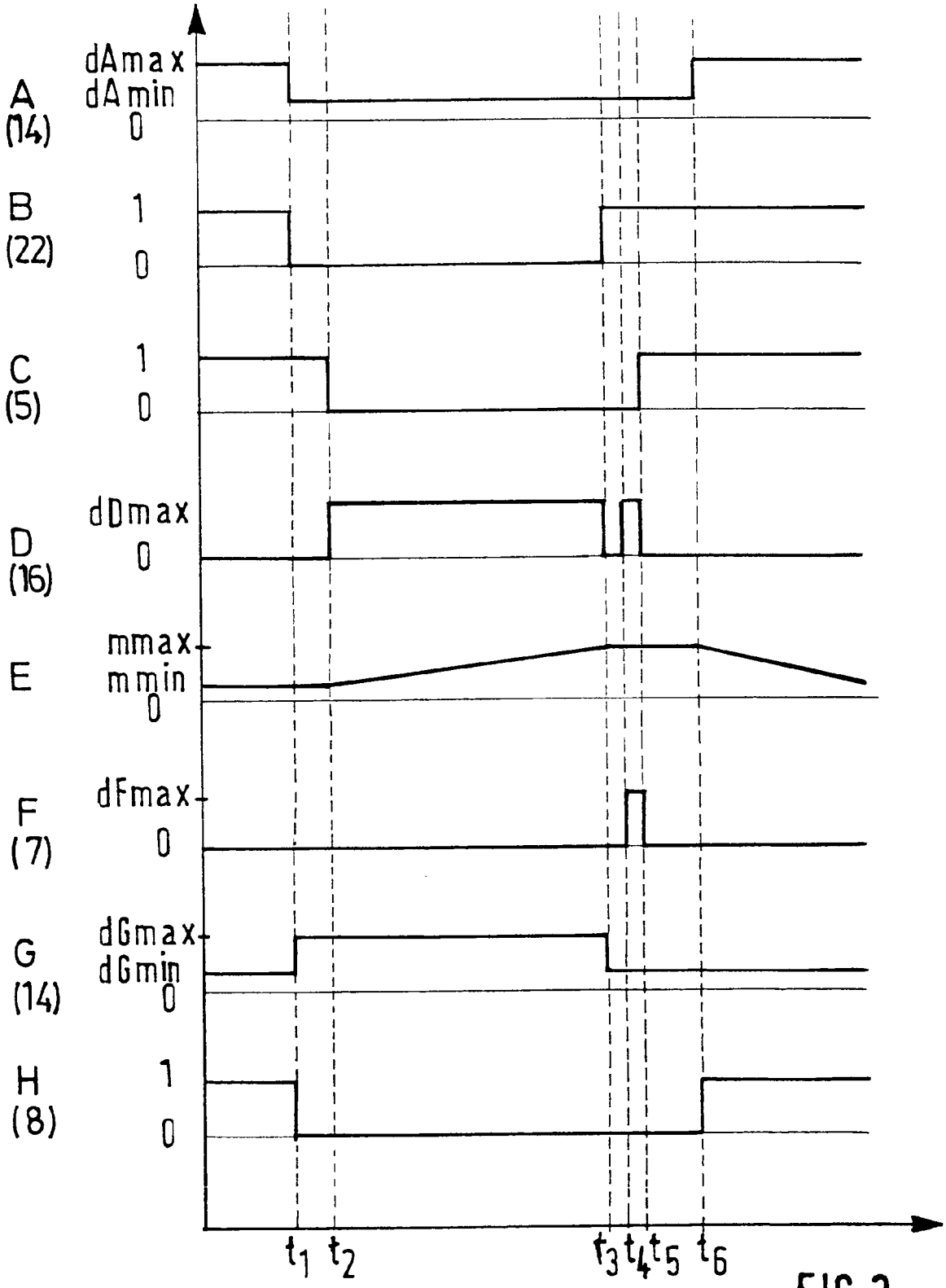
FIG. 3 is a graph illustrating the operation of the members of the equipment during the phases of the method.

There will now be set out the phases for filling the equipment and spraying with reference to FIG. 3, in which the following lines are illustrated, as a function of time t:

- Line A: the flow rate in the first air injection inlet 14 for the fluidisation, controlled by the proportional valve 24,
- Line B: the closed or open state of the pinch valve 22 which allows the flow to be stopped in the pressure reduction means; the value 1 indicates a closed valve, the value 0 indicates an open valve,
- Line C: the closed or open state of the powder supply pinch valve 5; the value 1 indicates a closed valve, the value 0 indicates an open valve,
- Line D: the flow rate in the air inlet of the Venturi device 16 of the pressure reduction means, controlled by the proportional valve 20,
- Line E: the mass of powder in the reservoir,
- Line F: the flow rate of air in the region of the air inlet 7 which constitutes the means for cleaning the powder supply valve 5,
- Line G: the flow rate in the air injection nozzle 14 for the fluidisation and for cleaning the pipe 8,
- Line H: the vertical position of the powder discharge pipe 8; the value 1 indicates an upper position, the value 0 indicates a lower position.

During a filling phase, initially, the equipment is in the following configuration, corresponding to the final spraying configuration:

- A: the flow rate in the first air injection inlet 14 for fluidisation is at a maximum value dAmin;
- B: the pinch valve 22 is closed,
- C: the powder supply pinch valve 5 is closed,
- D: the flow rate of air in the Venturi device is zero,
- E: the mass of powder is at a low value mmin,
- F: the flow rate of air in the region of the air inlet which constitutes the cleaning means of the powder supply valve 5 is zero,
- G: the flow rate of the air injection nozzle 14 for the fluidisation and for cleaning the pipe 8 is at a low value dGmax, which allows the local fluidisation of the powder in the region of the end of the discharge pipe to be carried out,
- H: the pipe 8 is in an upper position.

The filling phase is carried out in the following manner.

At a first time t1, the flow rate in the first air injection inlet 14 for the fluidisation, controlled by the proportional valve 24, moves to a minimum value dAmin, the pinch valve 22 which allows the flow to be stopped in the pressure reduction means is open which allows a flow to be established in the reduced pressure means, the flow rate of the air injection nozzle 14 is established at a high value dGmax which allows the powder discharge pipe 8 to be cleaned, this pipe being moved into the lower position.

At a second time t2, the powder supply pinch valve 5 is open, and the flow rate in the air inlet of the Venturi device 16 of the pressure reduction means controlled by the proportional valve 20 changes to a high level dDmax.

Under these conditions, the reservoir 2 is in a state of reduced pressure with respect to the conveying means and the powder is drawn towards the reservoir 2. The mass of powder in the reservoir increases. The pipe 8 is positioned against the air blowing nozzle 15 which allows it to be cleaned.

When the desired mass of powder mmax is reached, at a third time t3, the pinch valve 22 which allows the flow to be stopped in the pressure reduction means is closed, the flow in the air inlet of the Venturi device 16 of the pressure reduction means controlled by the proportional valve 20 is stopped, and the flow rate of the air injection nozzle 14 for the fluidisation and for cleaning the pipe 8 decreases to a low value dGmin sufficient for fluidisation.

At a fourth time t4, the flow rate in the air inlet of the Venturi device 16 of the pressure reduction means controlled by the proportional valve 20 is re-established at a value dDmax, whilst the valve 22 is closed, which allows an excess pressure to be created which allows the filter 19 to be cleaned without creating a state of reduced pressure in the reservoir; the flow rate of air in the region of the air inlet which constitutes the cleaning means of the powder supply valve 5 changes to a level dFmax which allows the valve 5 which is open to be cleaned.

It should be noted that the increase in the flow rate of air in the region of the air inlet which constitutes the means for cleaning the powder supply valve 5 and the increase of the flow rate in the air inlet of the Venturi device 16 of the pressure reduction means may be desynchronised. Furthermore, a plurality of pulses in the flow in the air inlet of the Venturi device 16 may provided in order to complete the cleaning of the filter.

At a fifth time t5, the powder supply pinch valve 5 is closed, the flow in the air inlet of the Venturi device 16 of the pressure reduction means, controlled by the proportional valve 20 is stopped, the air flow in the region of the air inlet constituting the means for cleaning the powder supply valve 5 is stopped.

Under these conditions, the conveying means are isolated from the reservoir and the pressure reduction means no longer function. The filling phase is complete, and the valve 5 of the conveying means, the powder discharge pipe 8 and the filter 19 of the pressure reduction means have been cleaned.

At a sixth time t6, the spraying phase begins, the discharge pipe being moved into the upper position, in which the powder in the reservoir 2 is able to enter the pipe 8, and the flow rate in the first air injection inlet 14 for the fluidisation increasing to a high value dAmax.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

Of course, the invention is not limited to the preferred embodiment described above, by way of non-limiting example, but instead includes all the variants thereof.

The invention claimed is:

1. An item of equipment for supplying powder to a powder-coating installation, the item comprising:

a reservoir, provided for containing the powder, means for conveying powder into the reservoir, means for injecting compressed air into the lower portion of the reservoir, in order to fluidise the powder, at least one pipe for discharging the powder carried by air, from the reservoir, this pipe being connected to at least one remote device for using the powder, in particular a spraying device, and, means for moving the powder discharge pipe between a first position in which the powder in the reservoir is able to enter the pipe, and a second position in which the inside of the pipe is separated in a fluid-tight manner from the inner space of the reservoir, wherein, the item of equipment further comprises means for reducing the pressure of the reservoir with respect to the conveying means for filling the reservoir with powder.

2. The item of equipment of claim 1, wherein the conveying means comprises a powder conveying conduit and a powder supply valve which is intended to block this conduit, the powder supply valve being associated with means for cleaning the valve when it is open.

3. The item of equipment of claim 2, wherein the conveying conduit comprises at least one section which is substantially horizontal and in the region of which the powder supply valve is arranged.

4. The item of equipment of claim 1, wherein the means for reducing the pressure of the reservoir with respect to the conveying means comprise a Venturi device which is associated with means for separating the air and the powder.

5. The item of equipment of claim 4, wherein the means for separating the powder and the air comprises a cyclone.

6. The item of equipment of claim 4, wherein the means for separating the powder and the air comprises a filter.

7. The item of equipment of claim 1, wherein the means for reducing the pressure of the reservoir with respect to the conveying means comprises a valve which allows the flow of air to be stopped downstream of the pressure reduction means.

8. The item of equipment of claim 1, wherein the means for injecting compressed air comprises a blowing nozzle, which fluidizes the powder and which is located opposite the end of the pipe during the spraying operation.

9. The item of equipment of claim 1, wherein, in the second position, the pipe is positioned against an air blowing nozzle which allows the pipe to be cleaned.

10. The item of equipment of claim 8, wherein the same air blowing nozzle allows the pipe to be cleaned when the pipe is in the lower position and allows the powder to be fluidised in the region of the end of the pipe when it is in the upper position.

11. The item of equipment of claim 1, comprising a permanent outlet which allows the pressure in the reservoir to be adjusted.

12. The item of equipment of claim 1, wherein the air injection means comprises at least one proportional valve which allows the pressure in the reservoir to be adjusted.

13. A method for supplying powder to a powder-coating installation, the method comprising:

a phase for filling a powder reservoir from powder conveying means, and a spraying phase in which the powder is fluidized, and the reservoir is emptied via a discharge pipe to at least one remote device for using the powder, in particular a spraying device, the reservoir being placed in a state of reduced pressure with respect to the conveying means for at least part of the filling phase, and, wherein a flow (dAmin) for fluidization of compressed air is maintained in the reservoir during the filling phase, and, wherein the powder discharge pipe is moved between a first position during the spraying phase, in which the powder in the reservoir is able to enter the pipe, and a second position of during the filling phase, in which the pipe is separated in a fluid-tight manner from the inner space of the reservoir.

14. The method of claim 13, wherein the conveying means comprises a powder supply valve which is intended to block a powder conveying pipe, and in which the powder supply valve is cleaned, then closed at the end of the filling phase.

15. The method of claim 14, wherein the reduced pressure state of the reservoir with respect to the conveying means is neutralized before the powder supply valve is cleaned.

16. The method of claim 13, wherein the pipe is cleaned by means of air being blown in the second position.

* * * * *